US006652027B1

(12) United States Patent
Pardonnet

(10) Patent No.: US 6,652,027 B1
(45) Date of Patent: Nov. 25, 2003

(54) PADDED BACKREST DEVICE WITH STAND-OFF SPACER ELEMENTS PARTICULARLY FOR USE WITH A TREE TRUNK BASE

(76) Inventor: Dennis Pardonnet, 12805 Via Catherina, Grand Blanc, MI (US) 48439

( * ) Notice: Subject to any disclaimer, the term of this patent is extended or adjusted under 35 U.S.C. 154(b) by 0 days.

(21) Appl. No.: 10/214,040

(22) Filed: Aug. 7, 2002

(51) Int. Cl.[7] ..... A47C 16/00

(52) U.S. Cl. ..... 297/230.12; 182/187; 108/152; 297/217.1; 297/230.1; 297/219.1

(58) Field of Search ..... 297/230.1, 230.12, 297/4, 217.1, 219.1; 182/187, 188, 135, 136, 20, 116; 108/44, 45; 248/218.4, 219.3, 219.4

(56) References Cited

U.S. PATENT DOCUMENTS

| | | | | | |
|---|---|---|---|---|---|
| 2,670,260 | A | * | 2/1954 | Watt | 108/129 |
| 2,701,173 | A | * | 2/1955 | Senior et al. | 108/43 |
| 3,030,160 | A | * | 4/1962 | Tandy | 108/135 |
| 3,625,463 | A | * | 12/1971 | Scholz | 248/219.3 |
| 4,025,105 | A | | 5/1977 | Pekala | 297/4 |
| 4,394,783 | A | | 7/1983 | Simmons | 5/432 |
| 4,553,634 | A | * | 11/1985 | Roberts et al. | 182/134 |
| 4,600,082 | A | * | 7/1986 | Rauls | 182/187 |
| 5,156,096 | A | * | 10/1992 | Lamprey | 108/152 |
| 5,234,076 | A | * | 8/1993 | Louk et al. | 182/187 |
| 5,273,246 | A | * | 12/1993 | Stahara et al. | 248/218.4 |
| 5,279,390 | A | * | 1/1994 | Phillips | 182/187 |
| 5,286,083 | A | * | 2/1994 | Mattison | 297/230.12 |
| 5,337,986 | A | * | 8/1994 | Vollink | 248/218.4 |
| 5,454,623 | A | | 10/1995 | Parks | 297/230.1 |
| 5,462,135 | A | | 10/1995 | Ambler et al. | 182/187 |
| 5,524,956 | A | | 6/1996 | Moore | 297/4 |
| 5,588,445 | A | * | 12/1996 | Obaidi | 128/846 |
| 5,782,531 | A | | 7/1998 | Shindle | 297/230.1 |
| 5,839,783 | A | | 11/1998 | Black | 297/380 |
| D444,918 | S | | 7/2001 | Suter | D29/100 |
| 6,328,131 | B1 | | 12/2001 | Backus | 182/187 |

FOREIGN PATENT DOCUMENTS

| | | | | |
|---|---|---|---|---|
| GB | 2226983 | A | * 7/1990 | A47B/17/00 |

* cited by examiner

*Primary Examiner*—Peter M. Cuomo
*Assistant Examiner*—Stephen D'Adamo
(74) *Attorney, Agent, or Firm*—Gifford, Krass, Groh, Sprinkle, Anderson & Citkowski, P.C.

(57) ABSTRACT

A backrest device for use with a tree trunk. A rigid backing exhibits a substantially rectangular and planar shape and includes a first side and a second side. A foam cushion is secured to the first side of the rigid backing. A plurality of stand-off spacers extend from the second side of the rigid backing, each of the spacers further having a projecting end surface. First and second elongated strap fasteners extend from each of first and second side edges of the rigid backing and, upon positioning the rigid backing with the spacers in abutting contact with the tree trunk and inter-engaging the fasteners about a circumference of the tree trunk, the rigid backing and secured cushion are spaced an incremental distance from the surface of the tree trunk and in order to prevent water running down the trunk from contacting the padded backrest or the back of the user.

9 Claims, 3 Drawing Sheets

PADDED BACKREST DEVICE WITH STAND-OFF SPACER ELEMENTS PARTICULARLY FOR USE WITH A TREE TRUNK BASE

BACKGROUND OF THE INVENTION

1. Field of the Invention

The present invention relates generally to outdoor backrest and support devices. More particularly, the present invention discloses a padded backrest device having a planar shaped and rigid backing and which is securable about a tree trunk base. The padded backrest device further provides a plurality of configured and stand-off spacers extending from a rear facing side of the rigid backing and in order to prevent rain or melting snow from contacting the back of the individual resting against the backrest.

2. Description of the Prior Art

The prior art is well documented with examples of both tree stand devices and related back support devices. The objective of the prior art is, to the extent possible, to provide effective back and lumbar support to the user, such further typically being a hunter or other individual engaged in an outdoor related pursuit.

U.S. Pat. No. 5,454,623, issued to Parks, teaches a backrest for use in resting against a tree and which includes a pad constructed of a resilient elastomeric material, having a generally trapezoidal configuration with a front face and a rear face. The pad is wider at its top edge than its bottom and further defines a plurality of apertures in rows and columns throughout the majority of its extent. Of additional note, a projection extends rearwardly from the rear surface of the pad adjacent its top edge, the projection further exhibiting a concave surface adapted to be received by the convex surface of the tree against which the pad is positioned. A plurality of belt loops are formed adjacent the top edge of the device with the holes of the loops in axial alignment for being supported on the belt of a user.

U.S. Pat. No. 5,782,531, issued to Shindle, teaches a further example of a compact backrest device in the form of a flexible sheet wrapped about a tree trunk. The sheet has a front side, a rear side and a peripheral edge. The peripheral edge has formed a first short edge, a second short edge and a pair of long edges therebetween. End straps extend as first and second pairs from opposite ends of the sheet and each includes a closure for coupling the together when the sheet is wrapped around the tree trunk. A plurality of padded sections are interconnected and attached to the front side of the sheet for supporting the user when the sheet is around the tree trunk.

SUMMARY OF THE PRESENT INVENTION

The present invention discloses a padded backrest device having a planar shaped and rigid backing and which is securable about a tree trunk base. The padded backrest device further provides a plurality of configured and stand-off spacers extending from a rear facing side of the rigid backing and in order to prevent rain or melting snow from contacting the back of the individual resting against the backrest.

In one given embodiment, the stand-off spacers are provided as upper and lower pairs of spacers and which extend in an outwardly angled fashion from the rear facing side of the rigid backing so as to correspond to the generally circumferential curvature of the tree trunk, and while providing a degree of both fixed positioning and stand-off support of the padded backrest. Further embodiments contemplate the ability to arrange the generally elongated and rectangular shaped backrest in either an upstanding or sideways extending fashion and to further reconfigure the stand-off spacers in either up or down angled or possibly straight extending fashion.

Straps extend from locations proximate both first and second sides of the backrest and, upon extending around the periphery of the tree trunk, are coupled together to secure the padded backrest in place. It is further contemplated that the straps may extend through slots formed through the rigid backing portion of the backrest.

BRIEF DESCRIPTION OF THE DRAWINGS

Reference will now be made to the attached drawings, when read in combination with the following detailed description, wherein like reference numerals refer to like parts throughout the several views, and in which.

DESCRIPTION OF THE PREFERRED EMBODIMENTS

Figure 1:
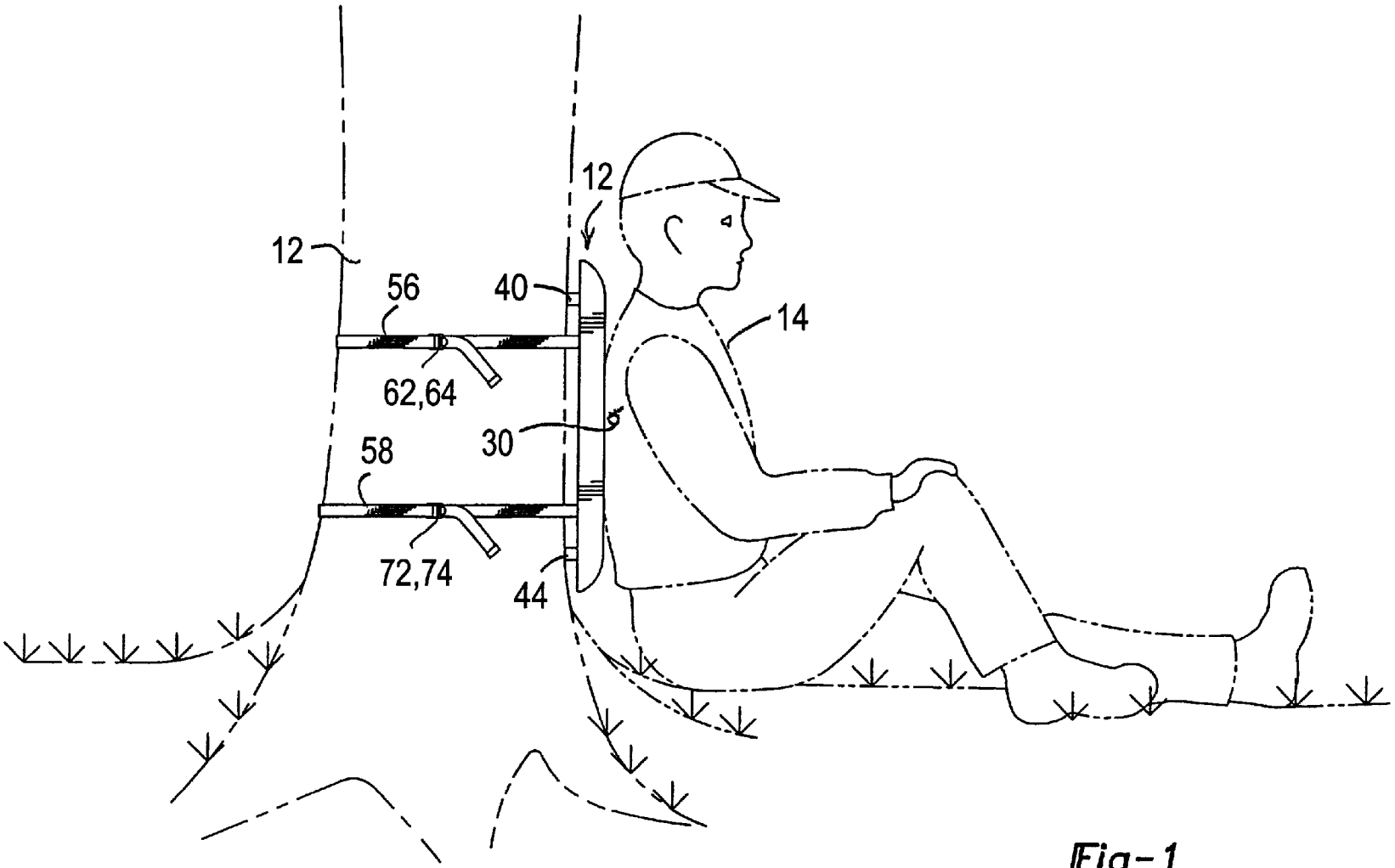
FIG. 1 is an environmental plan view of the padded backrest device according to the present invention secured about a base location of a tree trunk.
Figure 2:
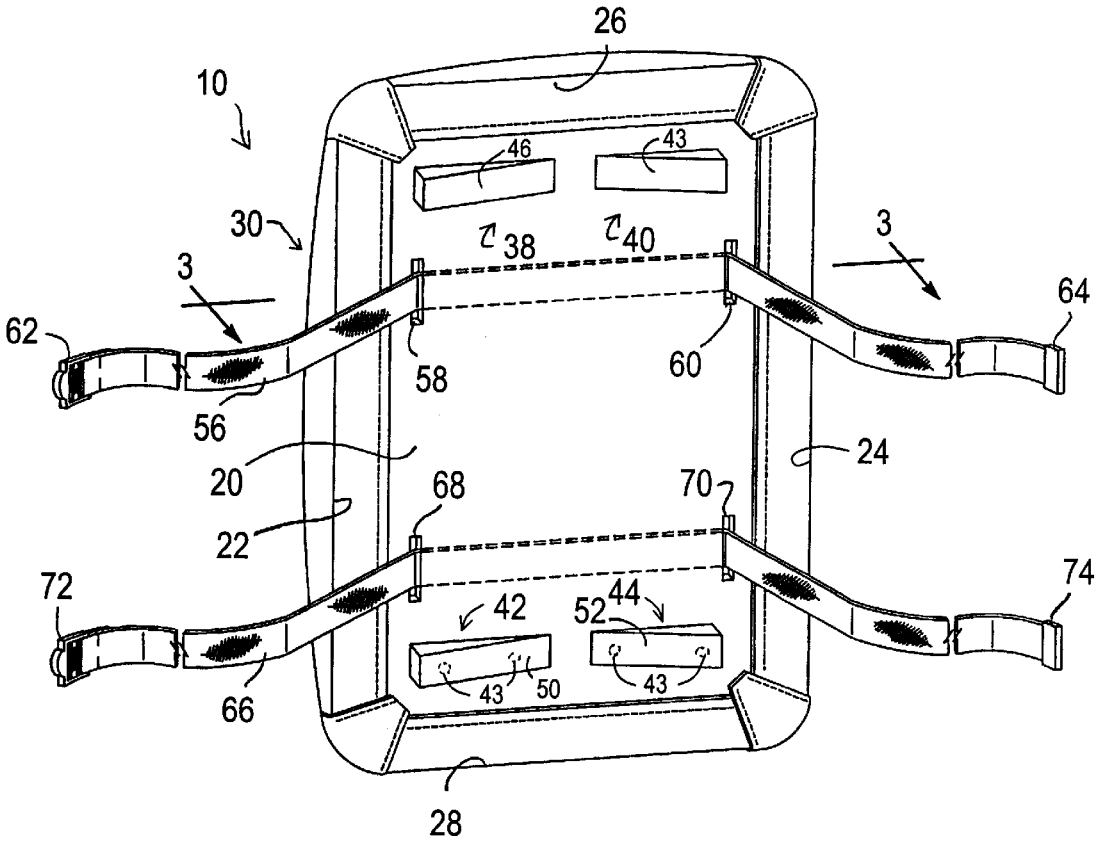
FIG. 2 is a perspective view of the padded backrest from a generally rear facing side and illustrating the configuration of the stand-off spacers arranged in a given pattern according to the present invention.

Referring now to FIGS. 1 and 2, a padded backrest device is illustrated at 10 according to a first preferred embodiment of the present invention and which is capable of being fastened about a given circumferential location of a tree trunk 12 in order to provide leaning back support to a user 14. As previously described, an advantage of the invention is in the placement and configuration of a plurality of stand-off spacers, extending from a rear facing side of the rigid backing, and which prevent rain or melting snow traveling down the tree trunk from contacting the back of the individual resting against the backrest.

A rigid backing (see in particular at 16 in FIG. 3) is provided, having a given thickness, and is preferably constructed of wood as well as possibly being constructed from other man-made materials such as including synthetics, hard plastics and the like. The rigid backing exhibits, in a given embodiment, a generally rectangular shaped and four sided configuration, it being further understood that the backing 16 can be shaped in any other suitable and multi-sided configuration within the scope of the invention.

Figure 3:
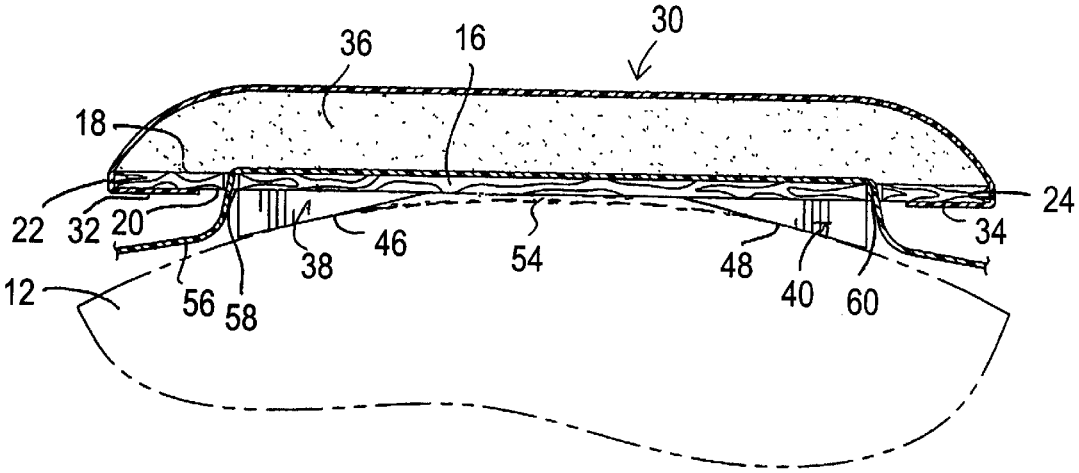
FIG. 3 is a cross sectional cutaway view of the padded backrest device illustrated in FIG. 1 and further showing the manner in which the stand-off spacers operate to space the rear facing side of the rigid backing an incremented distance from the surface of the tree trunk.

The rigid backing 16 further includes a first facing side 18 (FIG. 3) and a second opposite facing side 20 (FIGS. 2 and 3). The rigid backing 16 further includes a four sided periphery defined by opposite extending side edges 22 and 24 and interconnecting end edges 26 and 28.

A cushion, see generally referenced at 30, is secured in overlaying fashion upon the first facing side 18. Preferably, edges of the cushion 30 corresponding to the extending sides 22 & 24 and ends 26 & 28 of the rigid backing 16 are sewn, stapled or otherwise secured to the associated edge locations of the backing 16, see in particular underlaying flap portions 32 and 34 (referencing FIG. 3) folding over the associated side edges 22 and 24, respectively, of the rigid backing 16 and securing upon its second facing side 20. As again best shown in FIG. 3, the interior of the cushion fabric, designated at 30, is filled with a foam based material 36 or any other suitable material providing the desired characteristics.

The present invention further provides a plurality of stand-off spacers, see as generally referenced at 38 & 40 and at 42 & 44. Each of the spacers 38, 40, 42, and 44, may again be constructed of a wood and secured by fasteners (see at 43), glue or the like to the second facing side 20 of the rigid backing 16. The spacers may also be constructed of other suitable man-made materials, particularly if forming part of an injection molded or other suitably produced product.

As again best illustrated in FIG. 2, the spacers are provided as a first pair of upper and spaced apart spacers (see again at 38 and 40), as well as a second pair of lower and likewise spaced apart spacers (see again at 42 and 44). It is understood that the spacers 38, 40, 42 and 44 may be provided with any projecting end surface configuration, such including angled up or down and straightened end surfaces.

However, and according to the preferred embodiment, the spacers each include an angularly projecting end surface, see in particular at 46, 48, 50 and 52 in corresponding fashion to spacers 38, 40, 42 and 44. The angular projecting end surfaces 46–52 extend in directions corresponding to an associated and widthwise extending direction of the rigid backing 16 and towards their opposite and side extending edges 22 and 24. In this fashion, and upon positioning the second facing side 20 of the rigid backing 16 against the circumference of the tree 12, the angling of the end surfaces (see again at 46 and 48 in FIG. 3) causes the rigid backing 16 and cushion 30 to be spaced an incremental distance (see at 54 in FIG. 3) from the generally circumferential surface of the tree. As previously explained, this is so that such as rain water or melting snow running down the tree trunk will not contact the back of the individual leaning against the backrest device.

A pair of elongated fasteners, such as straps, are provided and which extend from locations proximate both the first 22 and second 24 extending sides of the backrest. In a given application, a first strap 56 extends through slots 58 and 60 defined proximate the extending sides 22 and 24. Opposite ends of the strap 56 terminate in interconnecting and releasable coupling portions 62 and 64. A second strap 66 likewise extends through slots 68 and 70 which are again defined proximate the extending sides 22 and 24 and in a lower spaced apart fashion in comparison to the slots 58 and 60. Opposite ends of the strap 66 terminate in interconnecting and releasable coupling portions 72 and 74.

Upon extending around the periphery of the tree trunk, the coupling portions of each associated strap end are inter-engaged together to secure the padded backrest in place. In addition to the slots, it is further contemplated that the straps may be integrally secured to the second facing side 20 of the rigid backing portion of the backrest and or that any number of straps, bungee cords, or other suitable elongated and flexible connecting portions.

Figure 4:
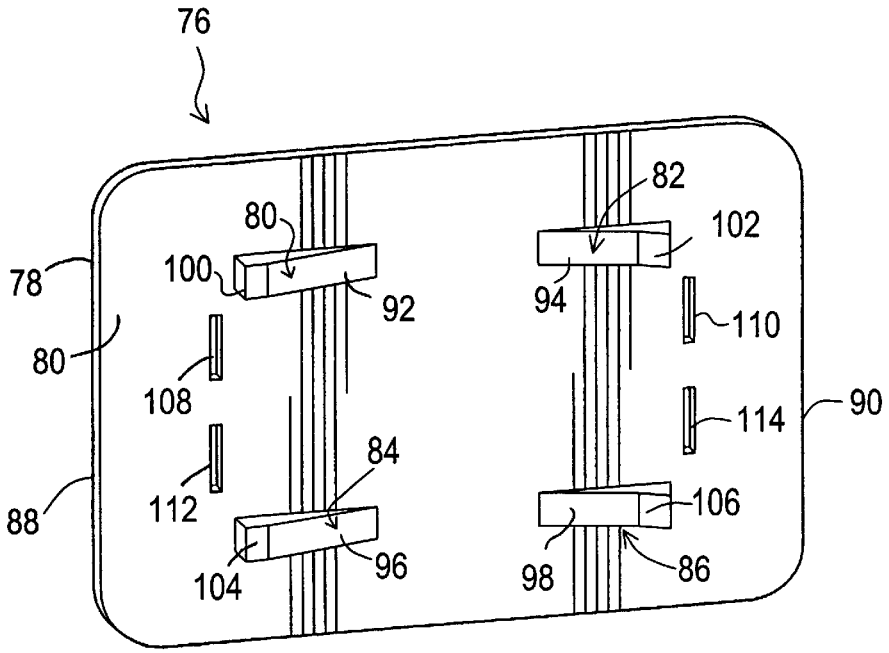
FIG. 4 is a view, similar to that shown in FIG. 2, and illustrating an alternating and sideways extending configuration of the padded backrest device according to the present invention.

Referring further to FIG. 4, an illustration is shown at 76 of a rigid backing member, forming part of a backrest device, and according to a further preferred embodiment of the present invention and in which the backing member is supported in a lateral or sidewise fashion against the tree trunk. The rigid backing member 76 is also largely similar to that previously described at 16 in reference to the first preferred embodiment and includes a first facing side 78 and a second facing side 80.

The primary distinguishing feature of the rigid backing member 76 is in the configuration and arrangement of the pairs 80 & 82 and 84 & 86 of the stand-off spacers. In particular, the spacers each again include angularly projecting end surface (in directions towards the opposite and side extending edges 88 and 90) as well as a planar end surface. Reference is specifically made to angularly projecting end surfaces 92, 94, 96 and 98 and corresponding and interconnecting planar end surfaces 100, 102, 104 and 106 for each of stand-off spacers 80, 82, 84 and 86, respectively. Pairs of apertures 108 & 110 and 112 & 114 are again illustrated in this embodiment and operate to receive associated strap fasteners (not shown).

Figure 5:
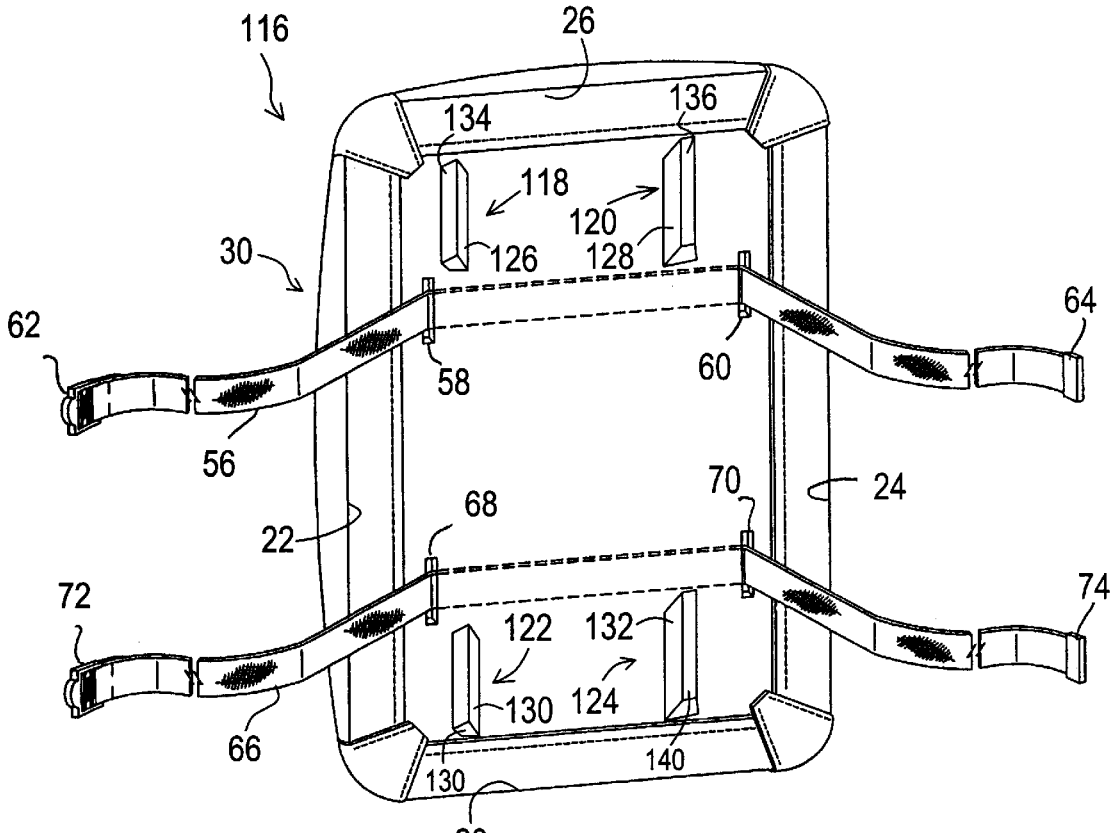
FIG. 5 is a perspective view of a padded backrest, similar to that previously illustrated in FIG. 2, again from a generally rear facing side and which illustrates a further configuration of stand-off spacers arranged in vertically extending fashion according to the present invention.

Referring finally to FIG. 5, a perspective view is illustrated at 116 of a padded backrest, similar to that previously illustrated in FIG. 2, and according to a yet further variant of the present invention. In particular, the backrest 116 is largely identical to that illustrated at 10 in FIG. 2, and accordingly all common elements are similarly renumbered and with no additional explanation or description being required.

The padded backrest 116 differs from that illustrated in 10 in that pluralities of first 118 & 120 and second 122 & 124 stand-off spacers are provided in alternating and lengthwise extending fashion. As with the earlier disclosed embodiment, the stand-off spacers again include angularly projecting end surfaces, with the exception that these angle outwardly and along a vertically extending direction as shown at 126, 128, 130 and 132 respectively for the spacers 118, 120, 122 and 124. Planar end support surfaces 134, 136, 138 and 140 may again be provided in interconnecting fashion with each of the corresponding angular extending surfaces 126–132.

Having described my invention, additional preferred embodiments will become apparent to those skilled in the art to which it pertains and without deviating from the scope of the appended claims.

I claim:

1. A backrest device for use with a tree trunk, comprising:

a planar shaped and rigid backing having a first side and a second side;

a cushion secured to said first side of said rigid backing;

a plurality of stand-off spacers secured to and extending from said second side of said rigid backing, said plurality of stand-off spacers further comprising a first pair of upper and spaced apart spacers and a second pair of lower and spaced apart spacers;

at least one elongated fastener extending from each of first and second side edges of said rigid backing; and upon positioning said rigid backing with said spacers in abutting contact with the tree trunk and inter-engaging said fastener about a circumference of the tree trunk, said rigid backing and secured cushion being spaced an incremental distance from the surface of the tree trunk.

2. The backrest device according to claim 1, said cushion further comprising a foam-filled cushion.

3. The backrest device according to claim 1, each of said spacers further comprising an angularly projecting end surface.

4. The backrest device according to claim 3, each of said angularly projecting end surfaces extending in a direction corresponding to an associated and elongate extending direction of said rigid backing.

5. The backrest device according to claim 3, each of said angularly projecting end surfaces extending in a direction corresponding to an associated and widthwise extending direction of said rigid backing.

6. The backrest device according to claim 1, said at least one elongated fastener further comprising first and second fasteners extending from each of said side edges, each of said fasteners terminating in a releasable coupling portion.

7. The backrest device according to claim 6, further comprising apertures in said rigid backing and through which extend said fasteners.

8. A backrest device for use with a tree trunk, comprising:

a rigid backing exhibiting a substantially rectangular and planar shape and having a first side and a second side;

a foam cushion secured to said first side of said rigid backing;

a plurality of stand-off spacers secured to and extending from said second side of said rigid backing, each of said spacers further comprising an angularly projecting end surface;

at least one elongated fastener extending from each of first and second side edges of said rigid backing; and upon positioning said rigid backing with said spacers in abutting contact with the tree trunk and inter-engaging said elongated fastener about a circumference of the tree trunk, said rigid backing and secured cushion being spaced an incremental distance from the surface of the tree trunk.

9. A backrest device for use with a tree trunk, comprising:

a rigid backing exhibiting a substantially rectangular and planar shape and having a first side and a second side;

a foam cushion securing about a periphery of said rigid backing and extending beyond said first side;

a plurality of stand-off spacers secured to and extending from said second side of said rigid backing, each of said spacers further comprising an angularly projecting end surface;

first and second elongated fasteners extending from each of first and second side edges of said rigid backing; and upon positioning said rigid backing with said angularly projecting end surfaces of said spacers in abutting contact with the tree trunk and inter-engaging the first and second fasteners about a circumference of the tree trunk, said rigid backing and secured cushion being spaced an incremental distance from the surface of the tree trunk.

* * * * *